US005551665A

United States Patent [19]

Noack et al.

[11] Patent Number: 5,551,665

[45] Date of Patent: Sep. 3, 1996

[54] BALL VALVE WITH COILED TUBING CUTTING ABILITY

[75] Inventors: Timothy Noack, Dumas; Wesley R. Allred, Dallas, both of Tex.

[73] Assignee: Halliburton Company, Dallas, Tex.

[21] Appl. No.: 236,787

[22] Filed: Apr. 29, 1994

[51] Int. Cl.[6] ..... F16K 31/122; E21B 29/00; E21B 34/16

[52] U.S. Cl. ..... 251/58; 166/324; 251/63.6; 251/315.10; 251/315.16; 251/315.01

[58] Field of Search ..... 251/58, 315 R, 251/315.10, 63.5, 63.6, 315.16; 166/322, 323, 324; 137/629

[56] References Cited

U.S. PATENT DOCUMENTS

| | | | |
|---|---|---|---|
| Re. 27,464 | 8/1972 | Taylor, Jr. | 166/5 |
| 3,411,576 | 11/1968 | Taylor, Jr. | 166/5 |
| 3,826,462 | 7/1974 | Taylor | 251/58 |
| 4,009,753 | 3/1977 | McGill et al. | 166/55.1 |
| 4,044,835 | 8/1977 | Mott | 251/58 |
| 4,160,478 | 7/1979 | Calhoun et al. | 166/55.1 |
| 4,421,171 | 12/1983 | Haynes | 251/58 |
| 4,494,609 | 1/1985 | Schwendemann | 166/336 |
| 4,522,370 | 6/1985 | Noack et al. | 251/63.5 |
| 4,651,828 | 3/1987 | Doremus | 251/58 |
| 5,050,839 | 9/1991 | Dickson et al. | 251/58 |
| 5,284,209 | 2/1994 | Godfrey | 166/380 |
| 5,338,001 | 8/1994 | Godfrey et al. | 251/58 |

*Primary Examiner*—George L. Walton
*Attorney, Agent, or Firm*—William Imwalle; Neal R. Kennedy

[57] ABSTRACT

A ball valve having the capability of cutting coiled tubing extending therethrough. The valve includes a ball rotatably disposed within a housing and adjacent to a seat. Control arms prevent relative longitudinal movement between the ball and seat. The ball defines a pair of slots therein, each slot having a bearing surface. A pair of control pins are disposed on opposite sides of the ball and rotatably disposed in corresponding control frames disposed on opposite sides of the ball. Each control pin has an end with a bearing surface thereon extending into a corresponding slot in the ball so that flat contact is provided between the control pin and the ball. This greater area of contact between the pins and the slots allows a greater load to be transmitted to the ball to provide the shearing load necessary to shear relatively large diameters of coiled tubing which extend through the open valve. The valve is opened and closed by pressure actuation of a piston.

29 Claims, 4 Drawing Sheets

BALL VALVE WITH COILED TUBING CUTTING ABILITY

BACKGROUND OF THE INVENTION

1. Field of the Invention

This invention relates to valve apparatus used in subsea well test safety equipment, and more particularly to a ball valve with the capability of cutting relatively large diameters of coiled tubing extending through the valve when the valve is closed in an emergency situation.

2. Description of the Prior Art

In the production testing of offshore wells, it is desirable to be able to quickly disconnect the production test string from the well in the event of an emergency such as adverse weather conditions. In making the quick disconnect, provision must be made for shutting in the well. This is commonly accomplished with a well apparatus referred to as a subsea test tree. A subsea test tree is a type of safety valve. Another device is a jack-up safety valve used on jack-up rigs which is also used to sever coiled tubing.

A typical example of a prior art subsea test tree is seen in U.S. Pat. No. 4,494,609 to Schwendemann. Quite often when the production test string is in place in a well, it will be necessary to run other tools down through the production test string and down through the subsea test tree. These other tools are typically run on a wireline or on coiled tubing.

It is common practice with subsea test trees such as that of Schwendemann, when an emergency situation arises, to close the ball valve member of the test tree while the wireline or coiled tubing still extends through the test tree, thus severing the wireline or coiled tubing by the shearing action of the ball valve member against its seat.

As procedures utilizing coiled tubing have evolved, the industry has moved toward use of larger diameters of coiled tubing. This presents an increased difficulty in severing the coiled tubing in emergency situations. That is, the introduction of larger diameter coiled tubing has initiated a need to increase capabilities in subsea well test safety equipment to insure that rig safety is not compromised when emergency closure of the safety valve is required during operations such as nitrogen jetting, acid spotting and fishing.

Various approaches have been suggested to improve upon the capability of a subsea test tree for cutting these larger strings of coiled tubing.

One approach is that shown in U.S. Pat. No. 4,009,753 of McGill et al., wherein a slot is cut in the lower portion of the spherical valve member so that when the ball valve moves to its closed position with a string of coiled tubing still in place, the lower portion of the coiled tubing string will be received in the slot of the ball valve and thus will not be placed in double shear type bending as the ball valve closes.

Another approach to the problem is seen in U.S. Pat. No. 4,160,478 to Calhoun et al. The Calhoun et al. device does not use a conventional spherical ball valve member, but instead uses a combined cutter/valve operator member mounted eccentrically within the housing and associated with a spherical seat surface which is also developed on an eccentrically positioned center.

Still another approach is presented in U.S. Pat. No. 5,284,209 to Godfrey which is specifically designed to cut larger strings of coiled tubing. This is accomplished without placing any recess in the spherical ball valve member, and thus has the major advantage of not weakening the ball by removing material from the ball. An eccentric recess is formed within the inner bore of the valve housing at a position diametrically opposed to the point where the spherical ball valve member closes upon coiled tubing to shear the coiled tubing. This allows a lower portion of a coiled tubing string to be received in the eccentric recess and thus substantially reduces the plastic deformation of the lower portion of the coiled tubing string as the ball valve member is closed to shear the coiled tubing. This significantly reduces the closing force necessary to cut a given string of coiled tubing, and thus allows a given subsea test tree design to reliably cut larger strings of coiled tubing than it otherwise could in the absence of the eccentric recess defined in the inner bore of the housing.

In each of the previous ball valve arrangements, a substantially cylindrical pin engages a slot in the ball to actuate the ball between its open and closed positions. This results in the contact between the pin and the wall surface of the slot being basically limited to a single line, and at one end of the rotation of the ball, even this line of contact is reduced because of the relationship of the pin with the curved outer surface of the ball. The shearing load necessary to cut large diameters of coiled tubing can result in damage to the ball or the pin because of the high loading resulting from this very small contact area.

The valve of the present invention solves this problem by providing a slot cut into the ball with a matching control pin which fits in the slot and is pivotally connected to a control frame. During an opening or closing cycle, the pin slides within the slot but maintains a relatively large, flat area of contact between the pin and ball, greatly reducing the stresses on these components. This allows greater loading without damage to provide the increased shearing loads necessary for cutting larger diameters of tubing. The valve of the present invention can also be easily retrofitted into old equipment, thereby increasing the tube cutting capabilities of such equipment. The design can also improve the operation of valves in which the ball is opened against differential pressure from below and also in situations where ball valves are used in sand service.

SUMMARY OF THE INVENTION

The present invention provides a ball valve improvement which allows greater shearing load for situations in relatively large diameter tubing must be cut, while minimizing the potential wear and damage areas normally existing in a ball valve. The ball valve is specifically designed for subsea applications, such as jack-up rigs and subsea test trees, although the device may be incorporated in substantially any known ball valve.

The valve comprises a control frame defining an opening therein, a seat adjacent to the control frame with the seat and control frame being relatively movable, a ball rotatably positioned adjacent to the seat and also adjacent to the control frame, and a control pin. The ball defines a slot therein which is formed at least in part by a bearing surface. The control pin comprises a first end extending into the slot and having a bearing surface thereon adapted for sliding engagement with the bearing surface on the ball. The control pin also comprises a second end extending into the opening.

Preferably, the valve further comprises a bushing disposed in the opening in the control frame, and the second end of the pin is adapted for pivotation within the bushing.

The bearing surface on the ball is preferably beveled, and the bearing surface on the first end of the control pin is preferably beveled to correspond with the bearing surface on the ball.

The valve may further comprise a control arm for holding the ball longitudinally with respect to the seat and allowing rotation of the ball with respect to the seat. The seat comprises spaced lugs with a gap defined therebetween, and a portion of the control arm is disposed through the gap and another portion of the control arm engages the lugs.

In the prefered embodiment, the valve also comprises a housing. The control frame is fixedly positioned in the housing, and the seat and ball are longitudinally movable with respect to the control frame.

The control pin has an angled side or notch thereon to avoid contact with the seat when the ball is moved to its open position.

Preferably, there are two sets of control frames, control pins and control arms positioned on opposite sides of a ball having two corresponding slots.

Relative movement between the control frames is prevented by a pair of alignment sleeves which engage the control frames. The control sleeves preferably define a notch therein, and relative rotation between the control sleeves and a lower seat is prevented by engagement of these notches by a lug extending from the lower valve seat.

Numerous objects, features and advantages of the invention will become apparent to those skilled in the art upon a reading of the following disclosure when taken in conjunction with the accompanying drawings.

BRIEF DESCRIPTION OF THE DRAWINGS

In FIGS. 1B and 1C, the left side shows the valve in the closed position, and the right side shows the valve in the open position.

DESCRIPTION OF THE PREFERRED EMBODIMENT

Figures 1A, 1B:
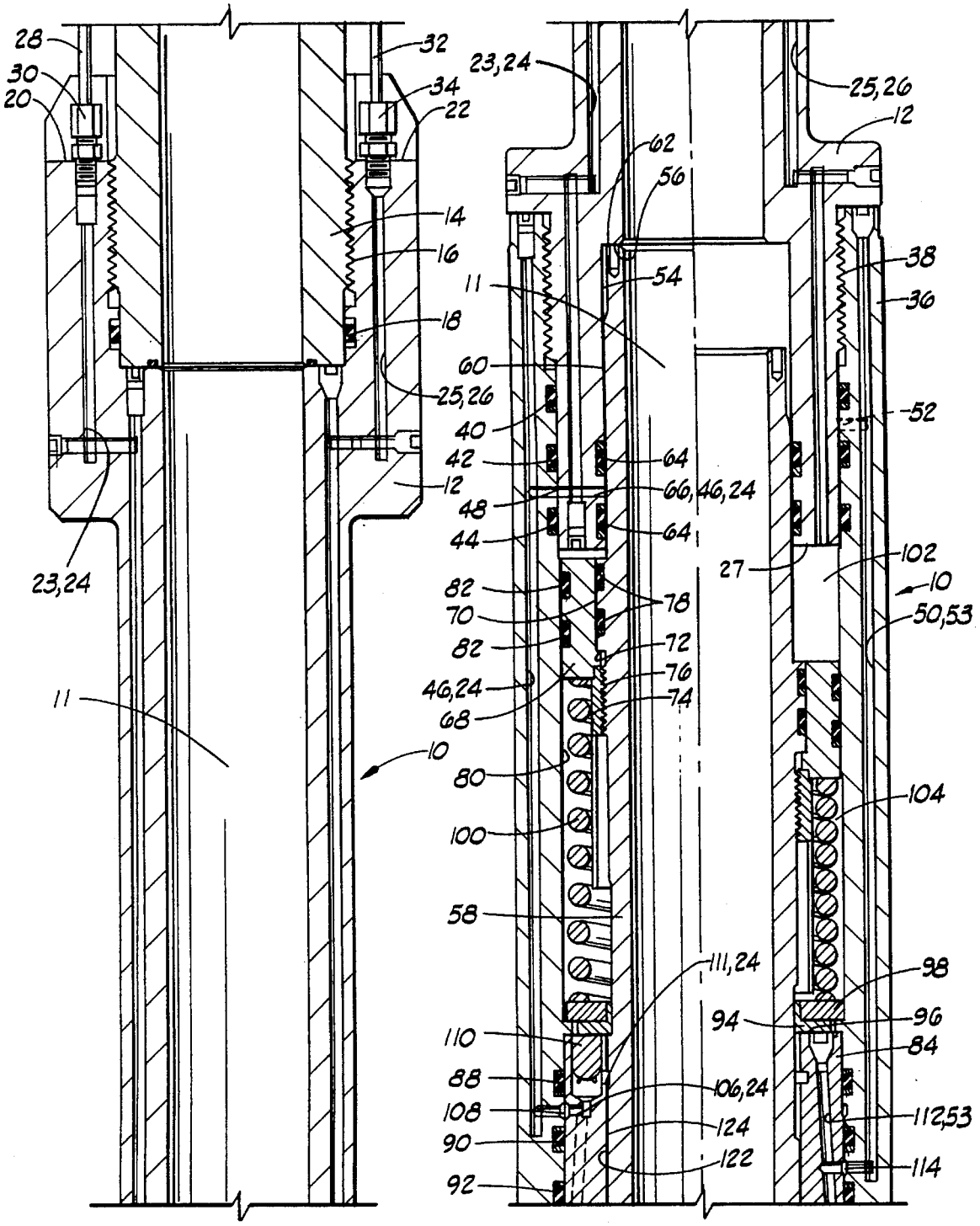
FIGS. 1A–1C show the valve of the present invention incorporated into a jack-up rig safety valve.
Figure 1C:
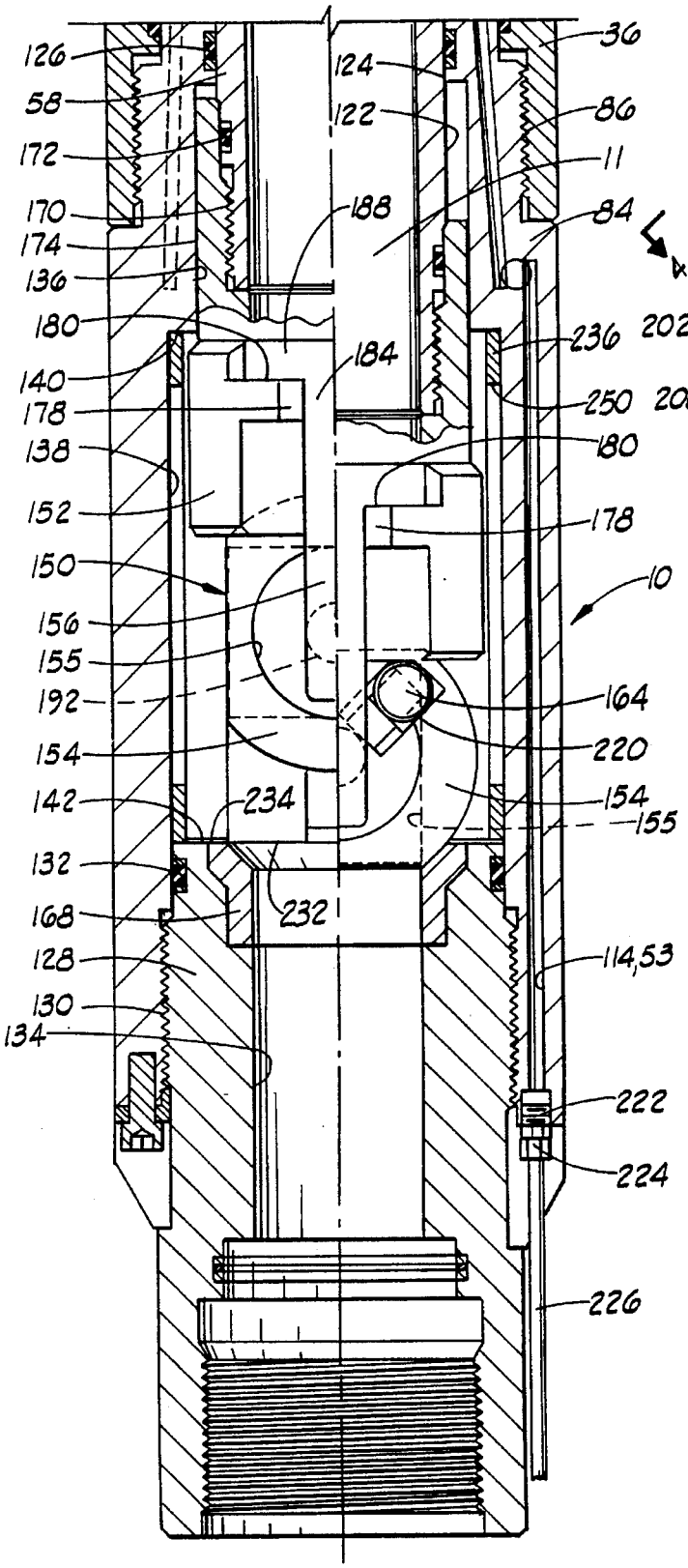

Referring now to the drawings, and more particularly to FIGS. 1A–1C, the valve of the present invention is shown as a safety valve for a jack-up rig, generally designated by the numeral 10. A central opening 11 is defined longitudinally through valve 10. It should be understood that such a safety valve 10 is only one application of the present invention, and the ball valve mechanism described in more detail herein may be incorporated in virtually any ball valve application. However, the device is particularly well adapted for use in situations where the ball valve is utilized to sever coiled tubing in an emergency situation, such as in subsea testing.

Referring now to FIG. 1A, valve 10 includes an upper body 12 connected to an upper portion 14 of the jack-up rig at threaded connection 16. A sealing means, such as O-ring 18 provides sealing engagement therebetween.

The upper end of upper body 12 has a pair of shoulders 20 and 22. Extending downwardly from shoulder 20 is a passage 23 forming an upper portion of a balance line passageway 24. As seen by the drawings, passage 23 is formed by a plurality of drilled holes with the outer ends thereof plugged. This type of formation of a passage is well known in the art, and therefore a detailed description of each hole and plug will not be provided herein. Another passage 25 forming an upper portion of a control line passageway 26 extends downwardly from shoulder 22. Passage 25 opens at lower end 27 of upper body 12 as seen in FIG. 1B. A balance line 28 is connected to balance line passageway 24 by a means known in the art, such as tube fitting 30. A control line 32 is connected to control line passageway 26 by a tube fitting 34.

Referring now to FIG. 1B, the lower end of upper body 12 is attached to spring housing 36 at threaded connection 38. Sealing engagement is provided between upper body 12 and spring housing 36 by a sealing means, such as a plurality of O-rings 40, 42 and 44.

Spring housing 36 defines a passage 46 therein which is in communication with passage 23 and upper body 12 at location 48. Thus, passage 46 forms a portion of balance line passageway 24. It will be seen that O-rings 42 and 44 seal on opposite sides of location 48 and between upper body 12 and spring housing 36.

Spring housing 36 also defines another passage 50 therein which is in communication with an unshown passage in upper body 12 at location 52. The unshown passage in upper body 12 is similar to passage 23 and is angularly spaced about the vertical axis of valve 10 from both of passages 23 and 25. The upper end of the unshown passage may be connected to a chemical injection line. Thus, it may be said that the unshown passage and passage 50 form portions of a chemical injection line passageway 53. There is no communication between balance line passageway 24, control line passageway 21 and chemical injection passageway 53. O-rings 40 and 42 provide sealing engagement between spring housing 36 in upper body 12 on opposite sides of location 52.

The lower end of upper body 12 defines a bore 54 therein with a downwardly facing shoulder 56 at the upper end of the bore.

An elongated piston 58 has a first outside diameter 60 slidably disposed within bore 54 of upper body 12. Upward movement of piston 58 is limited by contact of upper end 62 thereof with shoulder 56 in spring housing 36. A sealing means, such as a pair of O-rings 64 provide sealing engagement between first outside diameter 60 of piston 58 and upper body 12. O-rings 64 seal on opposite sides of a transverse portion 66 of passage 46.

An upper spring seat 68 is disposed around a second outside diameter 70 of piston 58 and clamped against an annular shoulder 72 by a seat retainer 74. Seat retainer 74 is connected to piston 58 by threaded connection 76. A sealing means, such as a pair of O-rings 78, provide sealing engagement between upper spring seat 68 and piston 58.

Upper spring seat 68 is thus movable with piston 58 and may be considered a portion thereof. Upper spring seat 68 is slidably received within a bore 80 in spring housing 36, and a sealing means, such as a pair of O-rings 82, provides sealing engagement between upper spring seat 68 and spring housing 36.

Referring also to FIG. 1C, the lower end of spring housing 36 is attached to valve housing 84 at threaded connection 86. A sealing means, such as a plurality of O-rings 88, 90 and 92, provide sealing engagement between spring housing 36 and valve housing 84.

A seat ring 94 is slidably disposed around piston 58 and adapted for substantially constant engagement with upper end 96 of valve housing 84. A lower spring seat 98 is positioned on seat ring 94 and located thereby. A biasing means, such as a spring 100, is disposed between upper spring seat 68 and lower spring seat 98, and it will thus be seen that upper spring seat 68 and piston 58 are biased upwardly by spring 100. This upward position is shown on the left side of FIGS. 1B and 1C, and as will be further described herein, corresponds to a closed position of valve 10.

A piston chamber 102 is defined annularly between piston 58 and spring housing 36 and above upper spring seat 68. A spring chamber 104 is similarly defined below upper spring seat 68. Preferably, but not by way of limitation, spring chamber 104 is filled with nitrogen. The nitrogen acts as a gas "spring" so that, as upper spring seat 68 and piston 58 are moved downwardly to reduce the volume of spring chamber 104, the nitrogen will be compressed, thereby increasing the pressure thereof. This increased pressure acts upwardly on upper spring seat 68 to bias the upper spring seat and piston 58 upwardly. Stated in another way, there is an upward biasing means which includes spring 100 and the nitrogen in spring chamber 104.

Valve housing 84 defines a passage 106 therein which is in communication with the lower end of passage 46 in spring housing 36 at location 108. It will thus be seen that passage 106 also forms a portion of balance line passageway 24. O-rings 88 and 90 seal above and below, respectively, at location 68.

A floating poppet valve 110 is disposed between spring chamber 104 and balance line passageway 24. When in the position shown in FIG. 1B, relief valve 110 is spaced above a balance port 111 formed in valve housing 84. Thus, it will be seen that balance port 111 is in communication with passage 106 and thus may be considered a portion of balance line passageway 24. It will be seen by those skilled in the art, because second outside diameter 122 of piston 58 is slightly smaller than first bore 124 in valve housing 84, that balance port 111 is in communication with spring chamber 104. In other words, spring chamber 104 is in communication with balance line passageway 24.

Fluid can be pumped through balance line passageway 23 so that the fluid enters spring chamber 104 through balance port 111. Thus, the pressure in spring chamber 104 can be increased to provide an additional upward force on upper spring seat 68 to force the upper spring seat and piston 58 upwardly. As will be further described herein, this provides additional force in severing coiled tubing extending through valve 10.

Valve housing 84 also defines another passage 112 therein which is in communication with passage 50 in spring housing 36 at location 114, and thus forms a portion of chemical injection line passageway 53. O-rings 90 and 92 seal on opposite sides of location 114.

The lower end of piston 58 has a second outside diameter 122 which is slidably disposed within a first bore 124 in spring housing 84. A sealing means, such as O-ring 126, provides sealing engagement between piston 58 and valve housing 84.

The lower end of valve housing 84 is attached to a lower adapter 128 at threaded connection 130. A sealing means, such as O-ring 132, provides sealing engagement between valve housing 84 and lower adapter 128. Lower adapter 128 has a bore 134 therethrough which is in communication with central opening 11 when valve 10 is open.

Valve housing 84 defines a second bore 136 which is somewhat larger than first bore 124 and an even larger third bore 138. A downwardly facing annular shoulder 140 is defined between second and third bores 136 and 138, and this shoulder generally faces upper end 142 of lower adapter 128.

Figure 2:
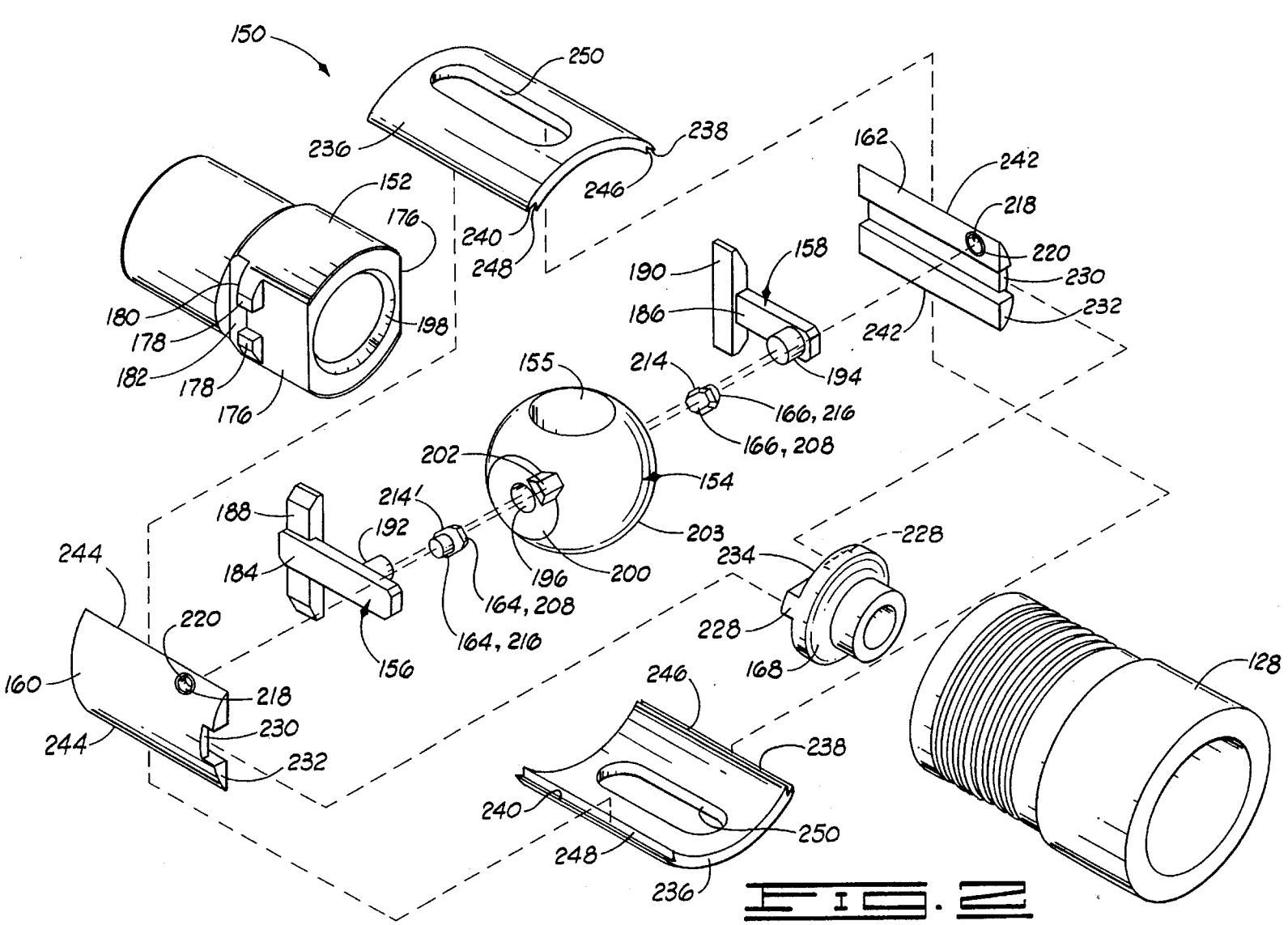
FIG. 2 is an exploded view of the valve assembly including upper seat, ball, control arms, control frames, control pins, bushings, alignment sleeves and lower seat.

A ball valve assembly 150 is disposed within valve housing 84 and generally located above lower adapter 128. Valve assembly 150 is an improved ball valve mechanism and is shown in an exploded view in FIG. 2. Lower adapter 128 is also seen in FIG. 2.

Valve assembly 150 comprises a first or upper seat 152, a ball 154 with a ball port 155 defined therethrough, first and second control arms 156 and 158, first and second control frames 160 and 162, alignment sleeves 163, first and second control pins 164 and 166, and a second or lower seat 168 which is disposed in lower adapter 128.

The lower end of piston 58 is attached to upper seat 152 at threaded connection 170, and thus the upper seat is moveable with the piston. A sealing means, such as O-ring 172 provides sealing engagement therebetween. Upper seat 152 has a first outside diameter 174 adapted for sliding within second bore 136 of valve housing 84.

On each side of upper seat 152 is a flat surface 176 with a pair of lugs 178 extending radially outwardly therefrom. Each lug 178 has an upper surface or shoulder 180 which faces upwardly. A recess 182 is defined above flat surface 176 and lugs 178.

First and second control arms 156 are generally T-shaped having vertical portions 184 and 186 with cross members 188 and 190 extending therefrom, respectively. A pivot pin 192 extends inwardly from vertical portion 184 of control arm 156, and similarly, a pivot pin 194 extends inwardly from vertical portion 186 of control arm 158.

Cross members 188 and 184 of control arms 156 and 158, respectively, are positioned in recesses 182 and are adapted to bear on shoulders 180 of lugs 178 on upper seat 152, with vertical portions 184 and 186 extending through the gap between adjacent lugs 178. The inner surface of each of vertical portions 184 and 186 substantially flatly contacts the corresponding flat surface 178. Pivot pins 192 and 194 on control arms 156 and 158, respectively, extend into pivot hole 196 in ball 154 which pivot hole is substanitally perpendicular to valve port 155. In this way, it will be seen that ball 154 is longitudinally held in substantially sealing engagement against seating surface 198 of upper seat 152, but ball 154 may be pivoted about pivot pins 192 and 194.

Figure 3:
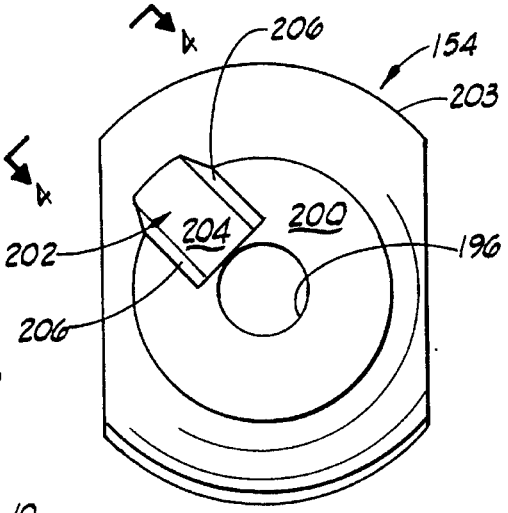
FIG. 3 is a side view of the ball showing a slot.
Figure 4:
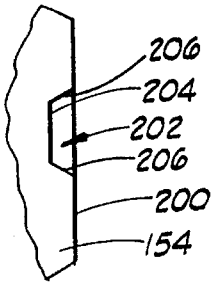
FIG. 4 is a detail elevation view as seen from lines 4—4 in FIG. 3.

Referring now to FIGS. 2–4, it will be seen that ball 154 has a pair of flats 200 parallel to the axis of valve port 155. Only one of flats 200 is visible in the drawings. Pivot bore 196 extends between flats 200, and it will be seen that vertical portions 184 and 186 of control arms 156 and 158 are partially in substantially flat contact with flats 200.

Each of flats 200 has a slot 202 therein which extends partially into curved outer surface 203 of ball 154. Each slot 202 has a flat bottom surface 204 with a pair of opposite, outwardly beveled sides or bearing surfaces 206 extending therefrom. Thus, as best seen in FIG. 4, slot 202 preferably has an equilateral, trapezoidal cross section. However, the invention is not intended to be limited to a trapezoidal shape, and other configurations may also be used. For example, the slots and control pins could have generally rectangular or other shape cross-sections.

Figure 5:
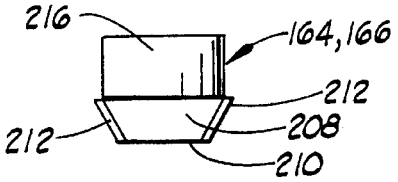
FIG. 5 is a side elevation view of a control pin.
Figure 6:
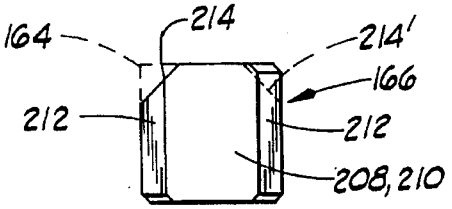
FIG. 6 is an end view of the control pin as seen from the bottom of FIG. 5.

Referring now to FIGS. 5 and 6, control pin 166 is shown in detail. Control pin 164 is basically a mirror image of control pin 166, and the differences in control pin 164 and from control pin 166 are shown in phantom lines in FIG. 6.

Control pin 166 has a first end having a substantially trapezoidal profile as seen in FIG. 5 with a flat side 210 and a pair of beveled sides or bearing surfaces 212. As seen in FIG. 6, first end 208 of control pin 166 also has an angled side or notch 214 which extends from one beveled side 212. The only difference between control pins 164 and 166 is that control pin 164 has an angled side or notch 214' extending from the other beveled side 212, as seen in the phantom lines of FIG. 6.

Referring again to FIGS. 2 and 5, control pins 164 and 166 also have a second, substantially cylindrical end 216.

Referring now to FIGS. 1C and 2, first end 208 of each of control pins 204 is adapted to slidingly fit within corresponding slots 202 in ball 154. It will be seen that beveled sides 212 of control pins 164 and 166 face the corresponding beveled sides 206 of each slot 202, and flat sides 210 of the control pins face bottom surface 204 of slots 202. As will be further described herein, depending upon the direction of load on control pins 164 and 166, facing beveled sides 206 and 212 provide a relatively large area of flat bearing contact between the control pins and ball 154. Each of second ends 216 of control pins 164 and 166 fits within an opening 218 in the corresponding control frames 160 and 162. Openings 218 are spaced in the same direction from a longitudinal axis of control frames 160 and 162. Preferably, but not by way of limitation, a bushing 220 is disposed in each opening 218. Second end 216 of control pins 164 and 166 are adapted to fit closely within bushings 220 so that the control pins are rotatable with respect thereto.

As seen in FIG. 2, lower seat 168 has a pair of opposite, upwardly extending lugs 228 thereon. Lugs 228 extend into notches 230 defined in the lower ends of control frames 160 and 162. Lower ends 232 of control frames 160 and 162 generally abut upper face 234 of lower seat 168. See also FIG. 1C. The interaction of lugs 228 with notches 230 helps prevent movement of control frames 160 and 162 within valve housing 84 which is particularly important when valve assembly 150 is closed to sever coiled tubing extending therethrough.

A pair of alignment sleeves 236 are disposed within valve housing 84 adjacent to third bore 138 thereof. Each alignment sleeve 236 has opposite longitudinally extending shoulders 238 and 240 thereon. Each of shoulder 238 of alignment sleeves 236 is adapted to fit adjacent to one of longitudinal edges 242 of control frame 162, and shoulders 240 on the alignment sleeves are adapted to fit adjacent to longitudinal edges 244 of control frame 160.

Each alignment sleeve 236 also has a pair of longitudinal faces 246 and 248 thereon. Faces 246 and 248 extend between control frames 160 and 162. Each face 246 abuts control frame 162, and each face 248 abuts control frame 160. It will thus be seen by those skilled in the art that alignment sleeves 236 and control frames 160 and 162 nest together so that, along with the interaction of lugs 228 on lower seat 168 with notches 230 in the control frames, any significant movement of the control frames and alignment sleeves is prevented. In other words, control frames 160 and 162, alignment sleeves 160, and lower seat 168 form a relatively rigid structure when placed together. This lack of movement is particularly important to prevent rotation or twisting of the parts within valve assembly 150 as the valve assembly is closed to sever a piece of coiled tubing extending therethrough.

Each of alignment sleeves 236 also defines an elongated slot 250 therethrough. These slots allow additional lateral room for the coiled tubing to bend as it is severed by the valve. That is, the coiled tubing can move all the way out so that it contacts third bore 138 in valve housing 84. In this way, the valve of the present invention accommodates the coiled tubing string and reduces the plastic deformation of the tubing string as it is cut by the closing ball valve in a manner somewhat similar to that shown in U.S. Pat. No. 5,284,209 to Godfrey, assigned to the assignee of the present invention. A copy of the Godfrey patent is incorporated herein by reference.

Referring again to FIG. 1C, the lower end of valve housing 84 has a downwardly facing shoulder 222 thereon, and passage 114 ends at this shoulder. A tube fitting 224, of a kind known in the art, is used to connect passage 114, and thus chemical injection line passageway 53 with a downwardly extending tube 226. Tube 226 is connected to lower portions of the jack-up rig in a manner known in the art so that chemicals may be injected through chemical injection line passageway 53 and tube 226 to any desired location below valve 10.

OPERATION OF THE INVENTION

Figure 7:
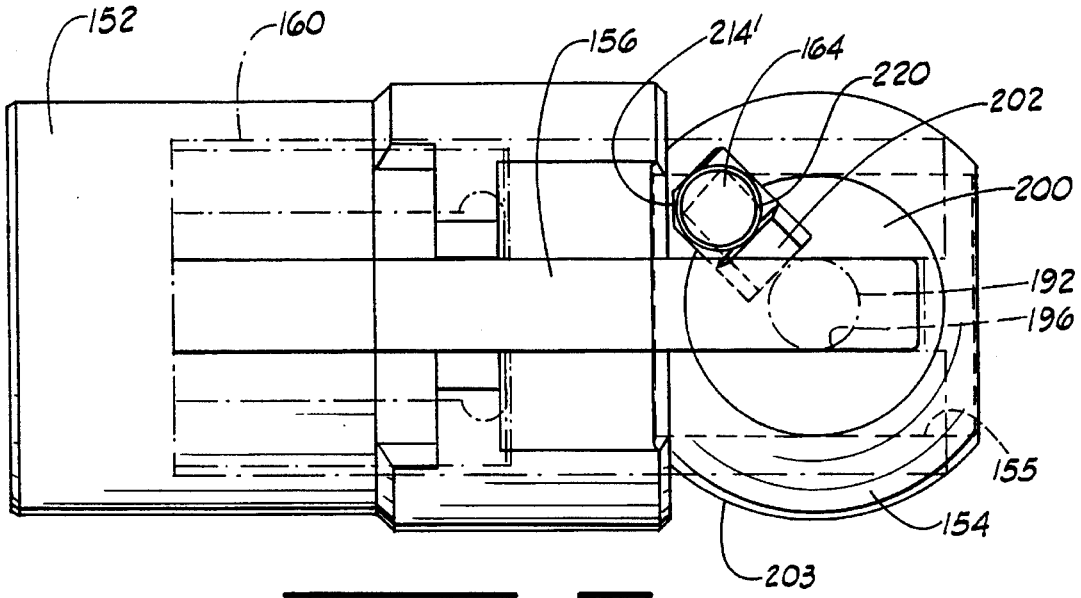
FIG. 7 is a view showing the ball valve assembly in an open position.
Figure 8:
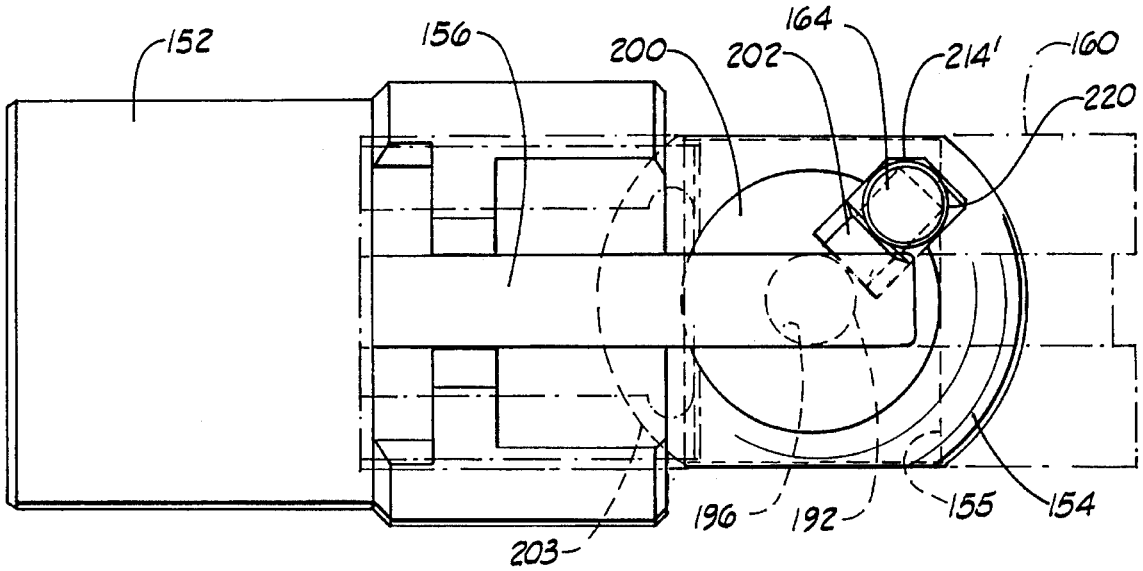
FIG. 8 shows the ball valve assembly in the closed position.

In FIG. 7 and the right sides of FIGS. 1B and 1C, valve 10 is shown in an open position in which valve port 155 is aligned with, and provides communication between, central opening 11 and bore 134 in lower adapter 128. Curvilinear outer surface 203 of ball 154 is in substanitally sealing contact with seating surface 198 in upper seat 152 and with lower seat 168 when in this position. In FIG. 8 and the left side of FIGS. 1B and 1C, valve 10 is shown in a closed position in which valve port 155 is perpendicular to central opening 11 and bore 134, and curvilinear outer surface 203 of ball 154 is sealingly engaged with seating surface 198 in upper seat 152. In studying the motion of the components in the operation of valve assembly 150, it should be understood that control frames 160 and 162 are preferably stationary and do not move significantly with respect to valve housing 84 or lower adapter 128.

Normally, with no pressure applied to control line passageway 26, valve assembly 150 of valve 10 is in the closed position in which spring 100 and the nitrogen charge in spring chamber 104 biases upper spring seat 68 and piston 58 upwardly so that upper end 62 of the piston contacts shoulder 56 in upper body 12, as seen in FIG. 1B. This upward position of piston 158 corresponding to an upward position of upper seat 152 since the piston is attached to the upper seat. As will be seen by those skilled in the art, control arms 156 and 158 maintain ball 154 in contact with upper seat 152, and thus ball 154 is also in an upper position. Referring to FIG. 8, control pin 164 is positioned radially outwardly in slot 202 and spaced away from pivot hole 196 in ball 154. Control pin 166 is similarly positioned.

To open valve assembly 150, control line passageway 26 is pressurized which also means that piston chamber 102 is pressurized. The pressure in piston chamber 102 exerts a downward force on upper spring seat 68, thereby forcing the upper spring seat and the piston 58 downwardly to compress spring 100. Of course, this results in upper seat 152, control arms 156 and 158, and ball 154 of ball valve assembly 150 also being moved downwardly. The interaction of control pins 164 and 166 with slots 202 in ball 154 cause the ball to be rotated as this downward movement occurs. When viewed in FIGS. 7 and 8, this rotation of ball 154 is counterclockwise. As the ball rotates through approximately 45°, control pins 164 and 166 slide radially inwardly within the corresponding slots 202 toward pivot hole 196. As ball 154 is rotated another approximately 45° counterclockwise, control pins 164 and 166 slide radially outwardly in the corresponding slots 202 away from pivot hole 196 until the control pins are in the position shown for control pin 164 in FIG. 7. Those skilled in the art will see that the total rotation of ball 154 through an opening cycle is approximately 90°. The ball pivots on pivot pins 192 and 194 of control arms 156 and 158, respectively.

As upper spring seat 68 and piston 58 are moved downwardly, any liquid from balance line passageway 23 which may have entered the lower portion of spring chamber 104 will be forced outwardly through balance port 111 by the nitrogen in the spring chamber. Further downward movement results in sufficient compression of the nitrogen that the pressure is increased sufficiently to move poppet valve 110 downwardly to cover balance port 111. This prevents escape of the nitrogen from spring chamber 104. It will be seen by those skilled in the art that the nitrogen acts as a gas spring in addition to mechanical spring 100 as upper spring seat 68 and piston 58 are moved downwardly. In other words, the mechanical force of spring 100 biases upper spring seat 68 and piston 58 upwardly, but the compressed nitrogen in spring chamber 104 also provides an upward biasing force.

Once valve 10 is opened, various downhole tools may be lowered on coiled tubing or a wireline through aligned central opening 11, ball port 155 and bore 134 in a manner known in the art.

To reclose the valve, pressure is relieved so that spring 100 and the compressed nitrogen in spring chamber 104 return upper spring seat 68 and piston 58 upwardly. Additional pressure may be provided by pumping fluid down balance line passageway 23 and into spring chamber 104 through balance port 111 as previously mentioned. This results in an increased force which allows ball 154 to sever coiled tubing extending therethrough when valve assembly 150 is closed. Ball 154 is correspondingly rotated clockwise from the position shown in FIG. 7 to the position shown in FIG. 8.

Because control pins 164 and 166 have beveled sides 212 adapted for flatly contacting the facing beveled sides 206, depending upon the direction of load, in slots 202 of ball 154, it will be seen that a much greater area of contact is provided than in previously known balls in which a round pin simply slides along one side of a slot. This allows a greater load to be transmitted from the control pins to ball 154 to provide the shearing load necessary to shear relatively large diameters of coiled tubing which extend through the open valve.

Additional bearing load is provided for first and second control arms 156 and 158 by the increased bearing area on lugs 178 and in recess 182 on upper seat 152. As previously described, additional strength is provided in valve assembly 150 by the interlocking arrangement of alignment sleeves 236, control frames 160 and 162, and lugs 228 on lower seat 168. Thus, as valve assembly 150 is closed to sever coiled tubing extending therethrough, sufficient strength is provided to the components and relative movement therebetween is prevented so that damage to the components or binding thereof is substantially eliminated. Additionally, as coiled tubing is severed, it can deflect into slot 250 of the adjacent alignment sleeve 236, in a manner similar to the previously described patent of Godfrey, which also helps minimize the loading in the valve assembly as it is closed against the coiled tubing.

The result of all of these improved features of valve 10 is that it can sever relatively large diameters of coiled tubing extending therethrough and still provide long life for the components in valve assembly 150.

It will be seen, therefore, that the ball valve with coiled tubing cutting ability of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A valve comprising:

a control frame defining an opening therein;

a seat adjacent to said control frame, said seat and control frame being relatively movable;

a ball rotatably positioned adjacent to said seat and also adjacent to said control frame, said ball defining a slot therein, said slot being formed at least in part by a bearing surface; and a control pin comprising:

a first end extending into said slot and having a bearing surface thereon adapted for sliding engagement with said bearing surface on said ball; and a second end extending into said opening;

wherein, when relative longitudinal movement occurs between said control frame and said seat, the engagement of said control pin with said control frame and said ball causes said ball to be rotated with respect to said seat and substantially simultaneously with such rotation said second end of said control pin pivots within said opening in said control frame and said first end of said control pin slides in said slot in said ball.

2. The valve of claim 1 further comprising a bushing disposed in said opening in said control frame; and wherein, said second end of said pin is adapted for pivotation within said bushing.

3. The valve of claim 1 wherein said opening is spaced from a longitudinal axis of said control frame.

4. The valve of claim 1 wherein:

said bearing surface in said ball is beveled; and said bearing surface on said first end of said control pin is beveled to correspond with said bearing surface on said ball.

5. The valve of claim 4 wherein said second end of said control pin is substantially cylindrical.

6. The valve of claim 4 wherein said first end of said pin has a substantially trapezoidal cross section.

7. The valve of claim 1 further comprising a control arm for holding said ball longitudinally with respect to said seat and allowing rotation of said ball with respect to said seat.

8. The valve of claim 7 wherein:

said seat comprises spaced lugs with a gap defined therebetween; and a portion of said control arm is disposed through said gap and another portion of said control arm engages said lugs.

9. The valve of claim 1 further comprising a housing, wherein:

said control frame is fixedly positioned in said housing; and said seat and ball are longitudinally movable with respect to said control frame.

10. The valve of claim 1 wherein said control pin has an angled side thereon to avoid contact with said seat when said ball is moved to said open position.

11. The apparatus of claim 1 further comprising a second seat on an opposite side of said ball from the first mentioned seat, said second seat having a lug extending therefrom; and wherein:

said control frame defines a notch on an end thereof; and said lug on said second seat extends into said notch in said control frame such that relative movement therebetween is prevented.

12. The valve of claim 1 wherein:

said control frame is one of a pair of control frames disposed on opposite sides of said ball; and further comprising a pair of alignment sleeves disposed adjacent to said control frames such that relative movement between said control frames is prevented.

13. The valve of claim 12 wherein said alignment sleeves define a longitudinal slot therein.

14. The valve of claim 7 wherein:

said seat defines a recess therein; and a portion of said control arm is disposed in said recess.

15. A valve apparatus comprising:

a housing;

a pressure actuated piston slidably disposed in said housing between first and second positions thereof;

biasing means for biasing said piston toward said first position; and a ball valve assembly disposed in said housing and comprising:

a seat attached to said piston;

a ball rotatable between open and closed positions adjacent to said seat, said ball defining a pair of slots on opposite sides thereof, each of said slots having a bearing surface therein;

a pair of control frames disposed adjacent to said sides of said ball, each of said control frames defining an opening therein; and a pair of control pins, each control pin being disposed between a side of said ball and a corresponding control frame and comprising:

a first end extending into the corresponding slot and having a bearing surface thereon adapted for sliding engagement with the corresponding bearing surface on said ball; and a second end extending into the corresponding opening in the adjacent control frame;

wherein, as said piston is moved from said first position to said second position, relative longitudinal movement between said seat and said control frames occurs such that said ball is rotated from said closed position to said open position and during such rotation, said second ends of said control pins are pivoted within the corresponding openings in the adjacent control frames and said first ends of said control pins slide within the corresponding slots in said ball.

16. The valve of claim 15 further comprising a bushing disposed in each of said openings in said control frames such that the second end of the corresponding control pin is free to pivot within the bushing.

17. The valve of claim 15 wherein said openings in said control frames are spaced in the same direction from a longitudinal axis of said control frames.

18. The valve of claim 15 wherein:

said bearing surfaces on said ball are beveled; and said bearing surfaces on said first ends of said control pins are beveled to correspond with said bearing surfaces on said ball such that there is substantially flat contact therebetween.

19. The valve of claim 18 wherein said second ends of said control pins are substantially cylindrical.

20. The valve of claim 18 wherein:

said slots in said ball have a substantially trapezoidal cross section; and said first ends of said pins have a corresponding substantially trapezoidal cross section.

21. The valve of claim 15 further comprising a pair of control arms disposed adjacent to said sides of said ball for holding said ball longitudinally with respect to said seat.

22. The valve of claim 21 wherein:

said ball defines a pivot hole therethrough; and further comprising a pivot pin extending from each of said control arms into said pivot hole.

23. The valve of claim 21 wherein:

said seat has a pair of opposite flat surfaces thereon;

a pair of spaced lugs extends from each of said flat sides; and each of said control arms has a vertical portion extending between said lugs and a cross member portion engaging said lugs.

24. The valve of claim 23 wherein said seat defines a recess on each of said flat therefor adjacent to said spaced therefor; and wherein a portion of said cross member portions of said control arm are disposed in said recesses.

25. The valve of claim 23 wherein:

said lugs have a shoulder thereon; and said cross member portions bear against said shoulders on said lugs.

26. The valve of claim 15 wherein:

said seat is an upper seat;

each of said control frames has a notch defined in an end thereof; and further comprising a lower seat disposed on an opposite side of said ball from said upper seat, said lower seat comprising a pair of lugs, each of said lugs extending into the notch in each of said control frames so that relative movement between said control frames and said lower seat is prevented.

27. The valve of claim 15 further comprising a pair of alignment sleeves, each of said alignment sleeves being disposed between corresponding edges of said control frames such that relative movement between said control frames is prevented.

28. The valve of claim 27 wherein:

said seat is an upper seat;

each of said control frames has a notch defined in an end thereof; and further comprising a lower seat disposed on an opposite side of said ball from said upper seat, said lower seat comprising a pair of lugs, each of said lugs extending into the notch in each of said control frames so that relative movement between said control frames and said lower seat is prevented.

29. The valve of claim 27 wherein at least one of said alignment sleeves defines a longitudinally extending slot therein.

* * * * *